US005683207A

United States Patent [19]

Mauer

[11] Patent Number: 5,683,207

[45] Date of Patent: Nov. 4, 1997

[54] PIER ASSEMBLY AND METHOD OF INSTALLING SAME

[76] Inventor: Paul W. Mauer, 5600-38th Ave., Hyattsville, Md. 20782

[21] Appl. No.: 549,145

[22] Filed: Oct. 27, 1995

[51] Int. Cl.[6] ..... E02D 5/79

[52] U.S. Cl. ..... 405/244; 405/231; 405/232; 405/233; 52/170; 52/157

[58] Field of Search ..... 405/229, 230, 405/231, 232, 233, 244; 52/170, 155, 157

[56] References Cited

U.S. PATENT DOCUMENTS

| | | | |
|---|---|---|---|
| 2,846,852 | 8/1958 | Cappel | 52/170 |
| 3,703,812 | 11/1972 | Newton | 405/244 |
| 4,018,056 | 4/1977 | Poma | 405/233 |
| 4,650,372 | 3/1987 | Gorrell | 405/232 |
| 4,756,129 | 7/1988 | Webb | 405/244 X |
| 4,974,997 | 12/1990 | Sero et al. | 405/231 X |
| 5,011,336 | 4/1991 | Hamilton et al. . | |
| 5,120,163 | 6/1992 | Holdeman et al. . | |
| 5,123,209 | 6/1992 | Nally | 405/230 |
| 5,139,368 | 8/1992 | Hamilton et al. . | |
| 5,171,107 | 12/1992 | Hamilton et al. . | |
| 5,234,290 | 8/1993 | Collins . | |
| 5,482,407 | 1/1996 | Raaf | 405/229 X |
| 5,486,071 | 1/1996 | Bullivant | 405/233 X |

FOREIGN PATENT DOCUMENTS

| | | | |
|---|---|---|---|
| 81 24322 | 12/1981 | France . | |
| 5209415 | 8/1993 | Japan | 405/231 |

*Primary Examiner*—Tamara L. Graysay
*Assistant Examiner*—Frderick L. Lagman
*Attorney, Agent, or Firm*—Watson Cole Stevens Davis

[57] ABSTRACT

A method and apparatus for supporting various structures, and especially freestanding structures such as walkways, boardwalks, prefabricated buildings, electrical towers, and decks. The apparatus includes a pier assembly comprising a pier member connected to a helix, the pier member also having a compression member fixed to an intermediate portion thereof. The compression member having an upper end, a lower end, and an outer surface of a generally frusto-conical configuration. Upon rotation of the pier assembly, the compression member is forced downwardly into the earth thereby compressing and compacting the earth there beneath to provide a stable support structure. Furthermore, a tubular member may be inserted at the upper end of the compression member and a body of rigid material may be provided within both the compression member and the tubular member.

13 Claims, 4 Drawing Sheets

Fig. 1.
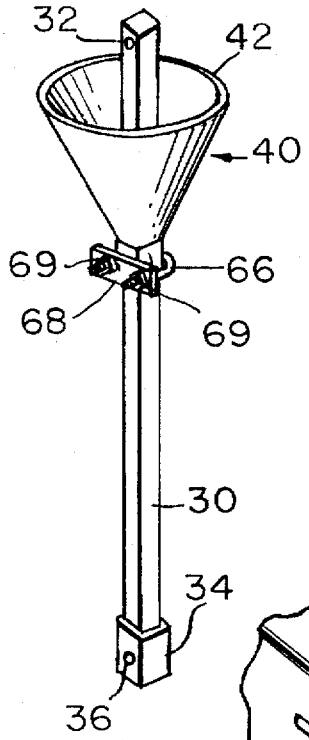
Fig. 2.
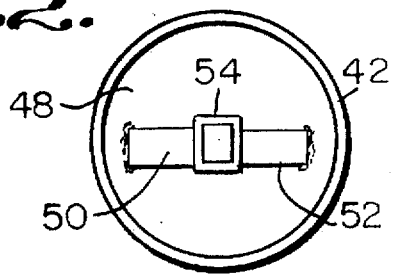
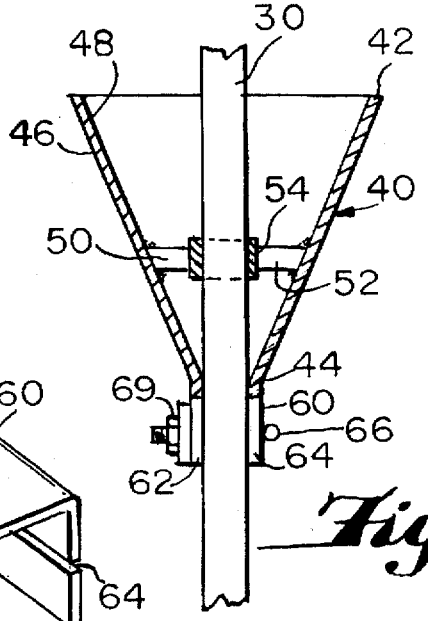
Fig. 3.
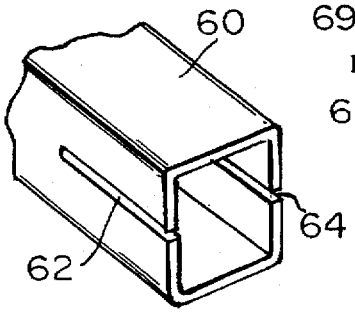
Fig. 3a.
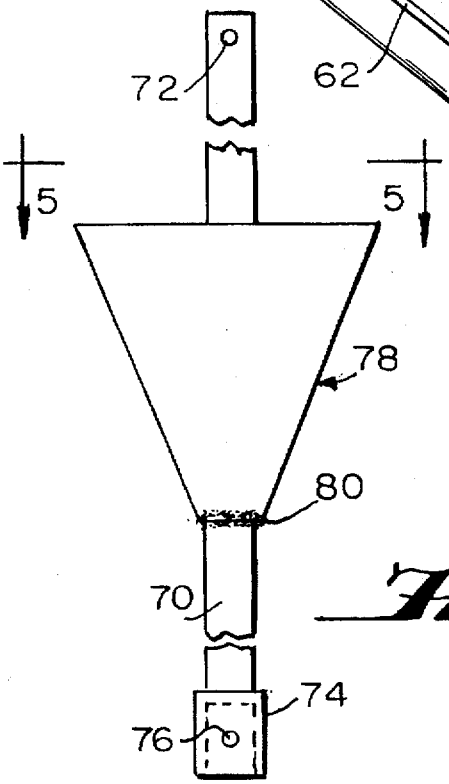
Fig. 4.
Fig. 5.
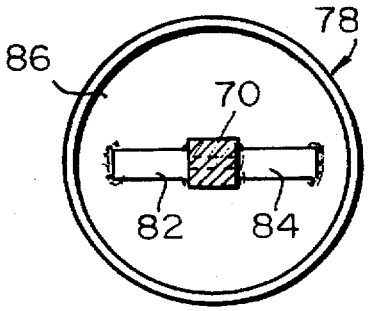

Fig. 12.
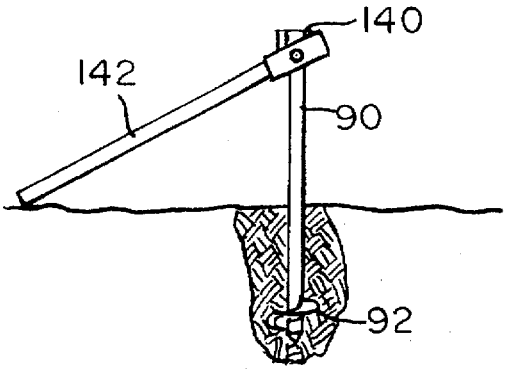
Fig. 13.
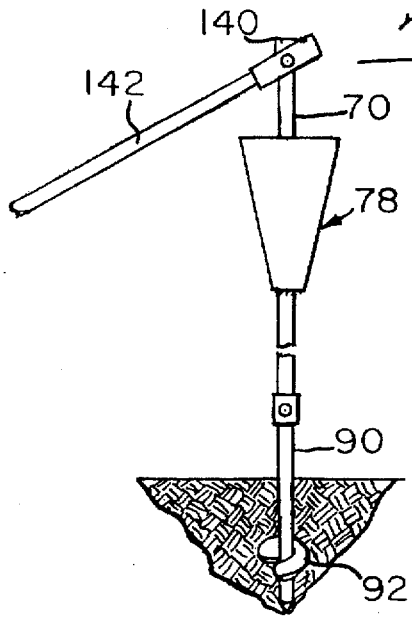
Fig. 14.
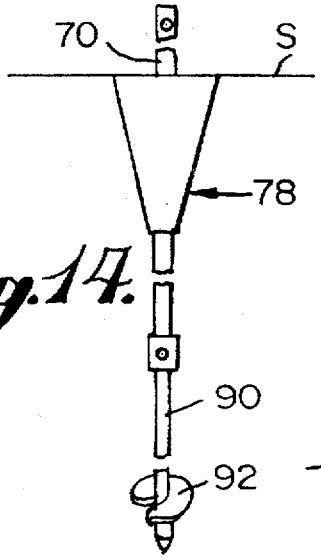
Fig. 15.
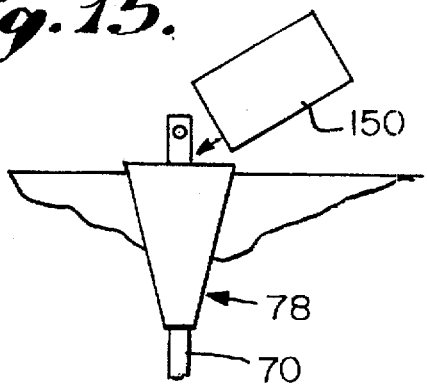
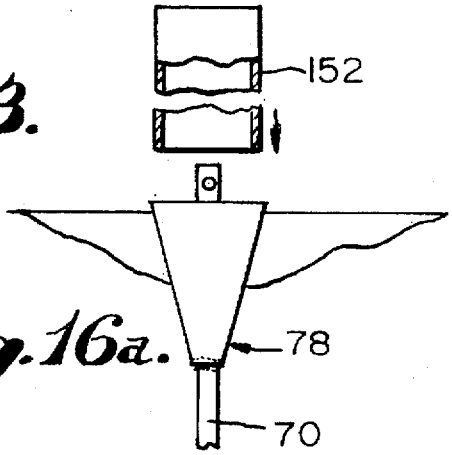
Fig. 16a.
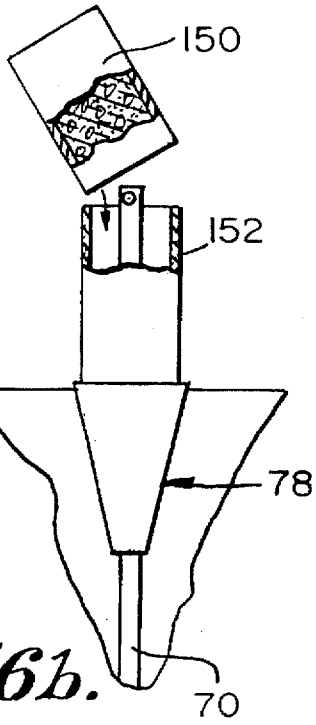
Fig. 16b.

PIER ASSEMBLY AND METHOD OF INSTALLING SAME

BACKGROUND OF THE INVENTION

The present invention relates to a pier assembly which is adapted for supporting various structures, and especially freestanding structures such as walkways, boardwalks, prefabricated buildings, electrical towers, decks and the like. Pier assemblies in the prior art utilize a helical pier having a helix at the lower end thereof which is adapted to draw the pier vertically downwardly into the earth therebeneath when the pier is rotated. Usually, a number of extension piers are interconnected with the helical pier as the helical pier is forced into the earth until the helical pier encounters earth which is sufficiently compacted to provide a secure anchor for the pier assembly.

Such pier assemblies can provide quick and reliable support for freestanding structures in a vertical direction, but provide little support in a lateral direction. Accordingly, it is often necessary to provide additional piers to ensure sufficient lateral stability. Such additional piers are called batter piers which extend into the earth at an angle to vertically extending extension piers and are connected thereto. The connection between a vertical extension pier and a batter pier is usually difficult to make due to the angular relationship between the piers and the necessity of properly aligning the piers with one another. In fact, the connection between a vertical extension pier and a batter pier has been relatively makeshift, and a lack of a uniform system for making such connections has resulted in expensive job-by-job engineering.

Therefore, it is desirable to provide a practical and easily installed pier system which ensures that sufficient lateral stability is provided to the supported structure even without using batter piers, and further to provide an improved arrangement for connecting vertical extension piers to batter piers where the use of batter piers is necessary. Batter piers are usually required where high levels of lateral support are needed such as when the pier assembly supports enclosed walkways where wind load is a factor, when heavy structures are supported, or when the structure is supported by very weak soil.

SUMMARY OF THE INVENTION

The present invention employs the usual helix pier which is driven into the ground. Extension piers are subsequently interconnected with the helix pier and with one another until the helix pier is adequately anchored. A compression means is provided which serves a number of purposes. The compression means may be secured to the helix pier, but in most cases, the compression means is secured to an extension pier. The compression means is secured to the associated pier either permanently as by being welded thereto, or the compression means may be clamped to the pier in such a manner that the compression means can be secured to any portion of the pier and later removed therefrom, if desired.

The compression means tapers downwardly from a larger dimension to a smaller dimension so that when the compression means is drawn into the earth, it compresses and compacts the earth to provide greater lateral stability to the pier assembly. The very act of forcing the tapered compression means into the earth serves to provide improved lateral stability. The upper end of the compression means is open, and further increased lateral stability can be provided by forming a body of rigid material such as concrete within the compression means. This body of rigid material gives greater rigidity to the construction since associated pier has an intermediate portion thereof embedded within the concrete. Furthermore, the greatly increased mass of the structure tends to keep the pier assembly in position.

A further feature of the invention is that a tubular member can be inserted in the open upper end of the compression means, and a body of rigid material may be provided within both the compression means and the tubular member so that the rigid body of material extends a substantial distance above the upper end of the compression means.

An improved connection is provided between a vertical extension pier and a batter pier. This is accomplished with the use of a connecting member which is embedded within a rigid body of material either within the compression means or a tubular member inserted within the upper end of the compression means. This connecting member is adjustably connected to a threaded member connected to a batter pier so that the vertical pier and batter pier may be properly aligned with one another and connected to one another without any slack between the two piers.

The invention also provides novel method steps to install each of the various forms of the invention. These method steps can be carried out efficiently with relatively unskilled labor, minimizing the time and cost of installation.

BRIEF DESCRIPTION OF THE DRAWINGS

FIG. 1 is a top perspective view of a pier member having a compression means detachably secured thereto;

FIG. 2 is a top view of the structure shown in FIG. 1;

FIG. 3 is a vertical section through the compression means shown FIG. 1;

FIG. 3*a* is a perspective view on an enlarged scale of a sleeve connected to the lower end of the compression means shown in FIG. 3;

FIG. 4 is an elevation of a pier member having a compression means permanently secured thereto;

FIG. 5 is a top view taken along line 5—5 of FIG. 4;

FIG. 12 illustrates a first step in a method according to the invention;

FIG. 13 is a view of a subsequent step of the method;

FIG. 14 is a view of a further step of the method;

FIG. 15 illustrates a step in making a modified form of the invention;

FIG. 16*a* is a view of a step in making a further modified form of the invention;

FIG. 16*a* is a further step in the method in FIG. 16*a;*

DESCRIPTION OF THE PREFERRED EMBODIMENT

Figure 6:
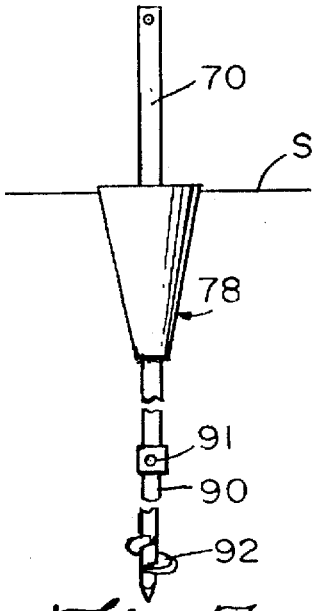
FIG. 6 is a view of the pier member shown in FIG. 4 after being driven into the earth.

Referring now to the drawings wherein like reference characters designate corresponding parts throughout the several views, a first form of the invention is shown in FIGS. 1–3*a* wherein an elongated extension pier member 30 is formed of galvanized steel bar having a square cross-section which may be about one and one-half inches on a side. A through hole 32 is provided at the upper end for connecting member 30 to another extension pier member, if necessary. Member 30 has an enlarged lower end 34 having a recess for snugly receiving the upper end of a pier member therebelow. A through hole 36 is provided in the lower end 34 for receiving a bolt which extends through a hole in the upper end of a pier member therebelow, a nut being threaded on the threaded end of the bolt to secure the pier members to one another. This construction is conventional in the prior art.

A compression means 40 is of generally frusto-conical configuration is open at the top ant tapers from a larger dimension at the upper end 42 thereof to a smaller dimension at the lower end 44 thereof. The compression means may also be formed of galvanized steel and may be formed by providing a piece of galvanized steel sheet material 3/16" in thickness from which a blank is cut to the necessary configuration and then rolled into the shape illustrated whereupon the seam formed by opposite edges of the blank are welded together.

The compression means includes an outer surface 46 and an inner surface 48, each of which is of generally frusto-conical configuration. A brace means includes a pair of brace members 50 and 52 having the outer ends thereof welded to the inner surface 48 of the compression means. The inner ends of members 50 and 52 are connected to a tubular central portion 54 which defines a central opening which is complementary to and slidably receives pier member 30 so that when the compression means is mounted on the pier member, the assembly will have good lateral stability.

The lower end of the compression means is connected as by welding to a tubular sleeve portion 60 having an inner surface which is complementary to and slidably receives pier member 30. As seen in FIG. 3*a*, opposite walls of sleeve 60 have longitudinally extending slots 62 and 64 formed therein to provide a resilient lower portion on the compression means. A clamping means includes a U-bolt 66 having two legs extending through holes in a plate 68 with nuts 69 threaded on the threaded outer ends of the legs. This clamping means is adapted to clamp the resilient lower portion of the compression means in a fixed position on the pier member 30. It is evident that the compression means can be adjusted to any desired position on the pier member and fixed thereto; and the compression means can subsequently be removed from the pier member when desired. It should also be noted that a plurality of compression means can be mounted on a particular pier member, or more than one interconnected pier member in a particular pier assembly may have a compression means secured thereto.

Referring to FIGS. 4 and 5, a modified arrangement is provided wherein a pier member 70 has a through hole 72 at the upper end thereof and an enlarged hollow lower end 74 having a through hole 76 therethrough similar to pier member 30 previously described. The compression means 78 is similar to compression means 40 except that there is no sleeve at the lower portion thereof, and the bottom of the compression means is welded at 80 to pier member 70 so as to be permanently fixed thereto. As seen in FIG. 5, brace means is provided in the form of a pair of brace members 82 and 84 having the outer ends thereof welded to the inner surface 86 of the compression means with the inner ends of the brace members being welded to pier member 70. This provides a very rigid assembly.

It will be noted that in each of the two embodiments described above, the upper end of the pier member extends upwardly above the upper end of the compression means so that a structure may be supported on the upper end of the pier member. Also, the lower end of the pier member extends downwardly below the lower end of the compression member.

Referring to FIG. 6, a pier assembly utilizing the construction shown in FIG. 4 is shown in installed position. A conventional helical pier member 90 has been driven into the earth and extension pier member 70 has been connected to the helical pier member by a nut and bolt assembly 91. The interconnected pier members have been driven downwardly until the upper end of the compression means 78 is substantially aligned with or slightly below the surface of the earth indicated by the letter S. This arrangement provides substantially increased stability to the pier assembly.

Figure 7:
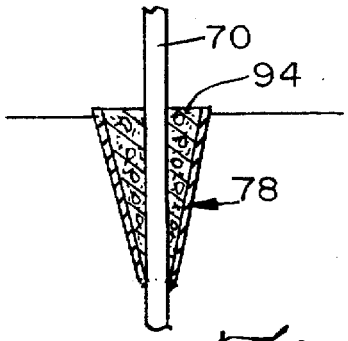
FIG.7 is a cross-section of a construction similar to FIG. 6 wherein the compression means is filled with concrete.

Referring to FIG. 7, the pier assembly is the same as that shown in FIG. 6 except that a rigid body of material 94 such as concrete is disposed within the compression means. It will be noted that an intermediate portion of the pier member 70 is embedded within the body of material 94. This arrangement provides even greater stability than that shown in FIG. 6.

Figure 8:
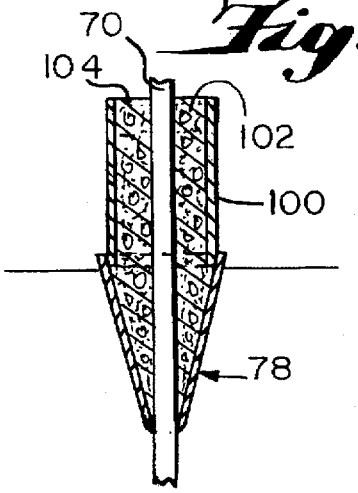
FIG. 8 is a cross-section of a compression means having a tubular member inserted in the upper open end thereof, both the compression means and the tubular member being filled with concrete.

Referring to FIG. 8, a modified pier assembly includes a tubular member 100 which is inserted within the open upper end of compression means 78. A rigid body of material is disposed within the compression means and within the tubular member. A substantial portion of the pier member 70 is embedded within the body of material 102. It is noted that body of material 102 extends a substantial distance above the upper end of the compression means, but the upper end of pier member 70 still extends above the upper surface 104 of the body of material for supporting a structure on the upper end of the pier member.

Figure 9:
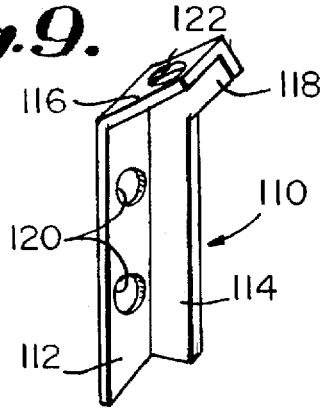
FIG. 9 is a perspective view of a connecting member according to the invention.

Referring to FIG. 9, a connecting member 110 according to the invention is formed of rigid material such a galvanized steel and includes a first flat body portion 112 having a flange 114 extending at right angles from one side edge thereof. Body portion 112 joins with a second flat body portion 116 extending at an angle to body portion 112. Body portion 116 has a flange 118 extending at right angles from one side edge thereof. A pair of holes 120 are formed through body portion 112, and a further hole 122 is formed through body portion 116.

Figure 10:
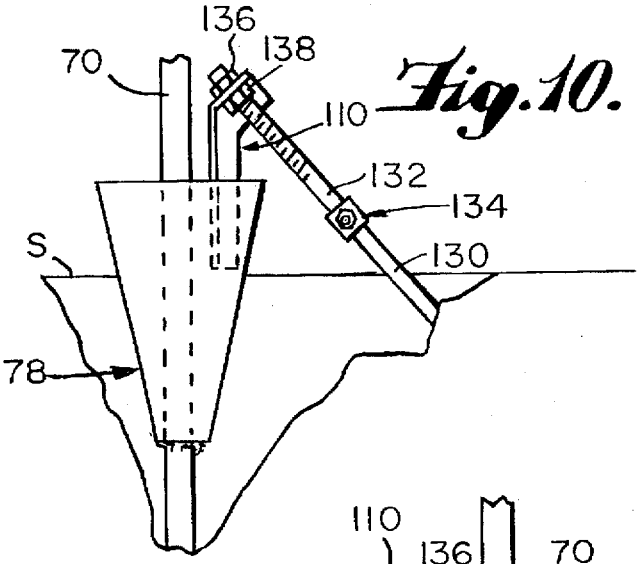
FIG. 10 is a view showing the connection between a vertical pier and a batter pier.

Referring to FIG. 10, a pier assembly includes extension pier member 70 having compression means 78 thereon which has been advanced only partly into the earth so that the upper end of the compression means is disposed above the surface S of the earth. A batter pier member 130 of conventional construction has been driven into the earth in the usual manner so that it is disposed at an angle to pier member 70 with the upper end of the batter pier member disposed above the surface S. A threaded member or stud 132 is connected by a nut and bolt assembly 134 to the upper end of batter pier member 130. The threaded end of member 132 extends through hole 122 of connecting member 110, and nut means in the form of two nuts 136 and 138 are threaded onto member 132 on opposite sides of body portion 116 of the connecting member to lock the connecting member to member 132. The connecting member 110 has the lower portion thereof embedded within a body of rigid material which is provided within the compression means 78 in a manner similar to that shown in FIG. 7. The rigid material extends through and fills the holes 120 provided in body portion 112 of the connecting member to securely anchor the connecting member within the body of rigid material within compression means 78.

Figure 11:
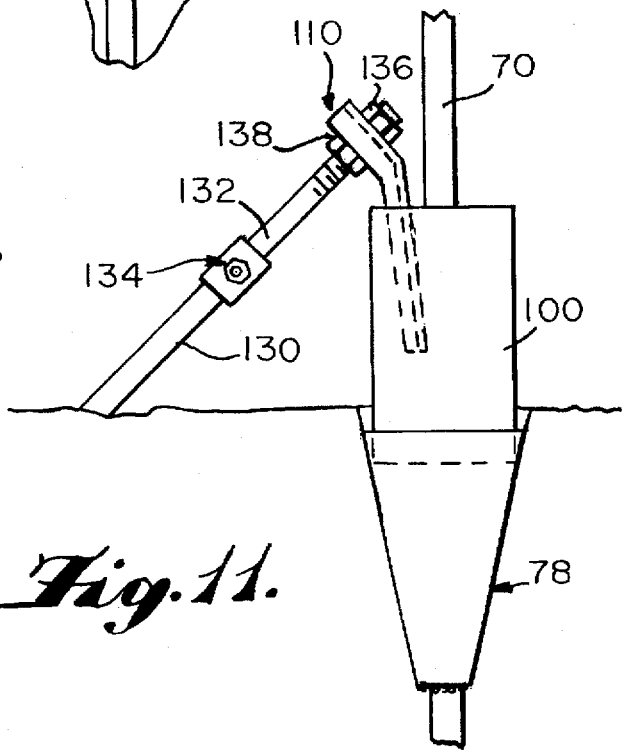
FIG. 11 shows a modified connection between a vertical pier and a batter pier.

Referring to FIG. 11, a pier assembly is shown wherein a tubular member 100 has a rigid body of material therein as shown in FIG. 8. In this embodiment, the lower portion of the connecting member 110 is embedded within a body of rigid material provided within the tubular member 110. The connecting member is thereby anchored within the body of rigid material and is connected to the threaded end of threaded member 132 in a manner to that described in connection with FIG. 10.

Referring to FIG. 12, a first step in a method according to the invention is illustrated. A conventional helical pier member 90 having a helix at the bottom thereof is interconnected with a conventional rotating driving means 140 which is adapted to rotate the helical pier to drive it into the ground in the usual manner. A stabilizing bar 142 is pivotally connected to the driving means, and a workman generally holds the outer end of bar 142 in contact with the earth to prevent the housing of the driving means from rotating during operation.

After the helical pier member is driven into the ground and it is determined that an extension pier member is needed, an extension pier member 70 is interconnected with the upper end of the helical pier member in the usual manner as shown in FIG. 13. The driving means then continues to drive the piers into the ground until the position is reached as shown in FIG. 14, with the top of the compression means substantially aligned with or below the surface S of the earth. At this point, the form of the invention shown in FIG. 6 has been installed. As the compression means moves downwardly into the soil, it compacts the soil and provides compressive and lateral support for the pier assembly.

Referring to FIG. 15, a container 150 is provided for inserting or pouring concrete into the compression means through the open upper end thereof, preferably substantially filling the compression means. The concrete then cures to form a rigid body of material within the compression means to form the construction shown in FIG. 7.

Referring to FIG. 16*a*, a tubular member 152 is formed of cardboard or the like and is, of course, open at the top and bottom thereof. The tubular member may be cut to any desired length. The lower end of the tubular member is inserted in the open upper end of the compression means after the compression means is driven into the position shown in FIG. 14. After the tubular member has been inserted in position, a container 150 containing concrete is provided for inserting or pouring concrete into the open upper end of tubular member 152 as shown in FIG. 16*b*. The concrete then cures to form a rigid body of material within the compression means and the tubular member to provide the construction shown in FIG. 8.

Figure 17:
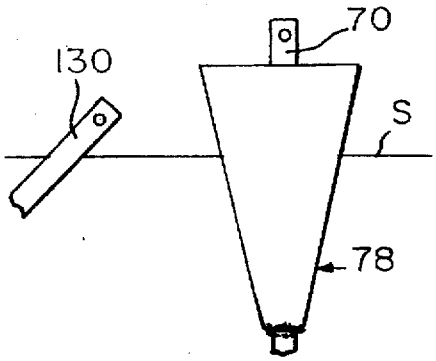
FIG. 17 shows a first step in a method employing both a vertical pier and a batter pier.
Figure 18:
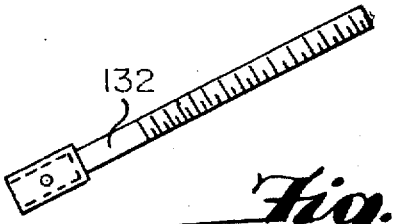
FIG. 18 shows a threaded stud used in the method of FIG. 17.
Figure 19A:
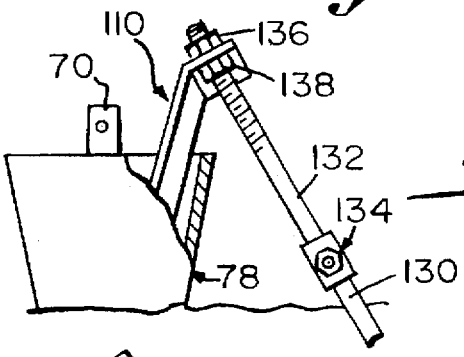
FIG. 19*a* shows the manner of supporting a connecting member in the method of FIGS. 17 and 18.

Referring to FIG. 17, a first step in a method employing both a vertical extension pier member and a batter pier member is disclosed. The vertical extension pier member 70 is first driven into the position shown with the upper end of the compression means being disposed above the surface S of the earth. The batter pier member 130 is driven into the position shown in a conventional manner. A threaded member 132 is then provided as shown in FIG. 18 and interconnected with the upper end of the batter member 130 by a nut and bolt assembly 134 as shown in FIG. 19*a*.

The connecting member 110 is placed so that a portion thereof extends downwardly through the open upper end of the compression means into the compression means, with the upper threaded end of member 132 extending through hole 122. The nut 138 is threaded onto member 132 before the threaded end of member 132 passes through the hole 122, and the nut 136 is then threaded onto the end of member 132 to lock the connecting member in place. The nuts are not fully tightened up at this time.

Figure 19B:
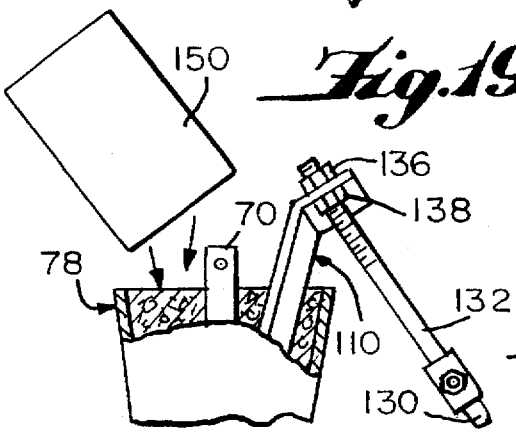
FIG. 19*b* shows a step subsequent to the step shown in FIG. 19*a;*

Concrete is then poured from a container 150 into the compression means as shown in FIG. 19*b*, and when the concrete cures, a rigid body of material is formed within the compression means with the lower portion of the connecting member 110 as well as an intermediate portion of pier member 70 embedded within the body of material. This method provides the construction shown in FIG. 10.

Figure 20:
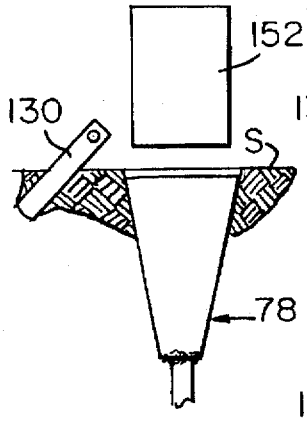
FIG. 20 shown a further method of the invention.
Figure 21:
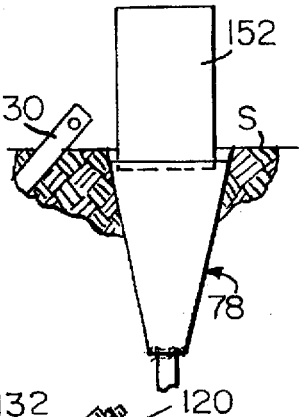
FIG. 21 shows a step subsequent to that shown in FIG. 20
Figure 22A:
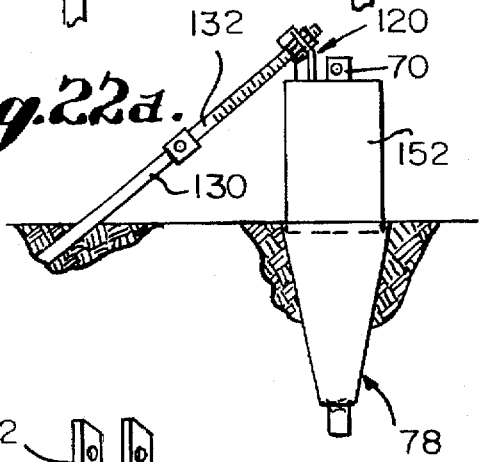
FIG. 22*a* shows a step subsequent to that shown in FIG. 21.

Referring to FIG. 20, a step in a further method of the invention is illustrated. The vertical extension pier member 70 and the batter pier member 130 have been driven into the position shown in FIG. 17. A tubular member 152 is provided and then inserted into the open upper end of the compression means 78 as shown in FIG. 21. As seen in FIG. 22*a*, threaded member 132 is then interconnected with the batter pier member and the connecting member 110 as described in connection with FIG. 19*a*, the only difference being that the connecting member is placed so that the lower portion thereof extends downwardly through the open upper end of the tubular member and into the tubular member rather than into the compression means.

Figure 22B:
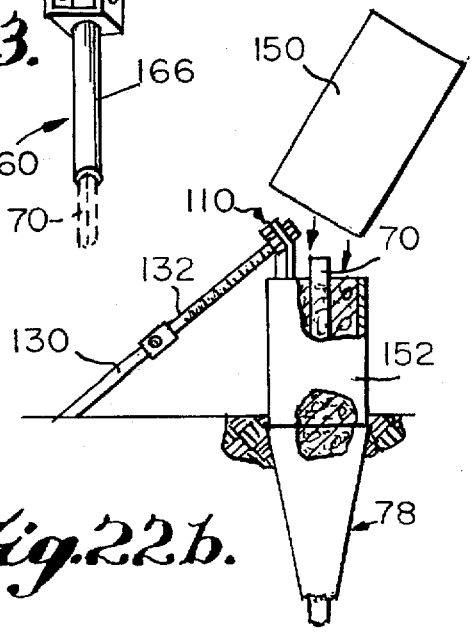
FIG. 22*b* shows a step subsequent to that shown in FIG. 22*a*.

A container 150 having concrete therein is than employed to insert or pour concrete through the open upper end of the tubular member as shown in FIG. 22*b* to substantially fill the compression means and the tubular member and form a body of rigid material therewithin with a substantial portion of pier member 70 and the lower portion of connecting member 110 being embedded therein. This method provides the construction shown in FIG. 11 of the drawings.

Figure 23:
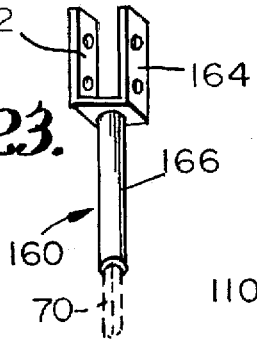
FIG. 23 is a perspective view of a U-shaped bracket.

Referring to FIG. 23, a conventional U-shaped bracket 160 includes spaced side walls 162 and 164 having suitable holes formed therethrough for connecting the bracket to mount lateral support beams for joist and deck structures. The bracket includes a hollow sleeve 166 which fits over the upper end of a vertical pier.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed:

1. A pier assembly comprising a load bearing pier member having a upper end and a lower end, compression means surrounding said pier member and having an open upper end and a lower end, said compression means having a first dimension at the upper end thereof and tapering to a second dimension at the lower end thereof, said second dimension being smaller than said first dimension, means for securing said compression means to said pier member in fixed relation thereto, said upper end of the pier member extending upwardly above said upper end of the compression means for supporting a structure on said upper end of the pier member, said lower end of the pier member extending below said lower end of the compression member, a tubular member having opposite open ends, one end of said tubular member being inserted within the open upper end of said compression means, a rigid body of material disposed within said compression means and said tubular member with a portion of said pier member being embedded within said body of material, wherein said body of material extends upwardly a substantial distance above said upper end of the compression means, said body of material having an upper surface, said upper end of the pier member extending above said upper surface.

2. A pier assembly comprising a first elongated load bearing pier member having an upper end and a lower end, a second elongated pier member disposed at an angle to said first pier member and having an upper end and a lower end, compression means surrounding said first pier member and having an upper end and a lower end, said compression means having a first dimension at the upper end thereof and tapering to a second dimension at the lower end thereof, said second dimension being smaller than said first dimension, means for securing said compression means to said first pier member in fixed relation thereto, said upper end of the first pier member extending upwardly above said upper end of the compression means for supporting a structure on said upper end of the pier member, said lower end of the first pier member extending below said lower end of the compression member, connecting means for connecting said upper end of the first pier member to the upper end of said second pier member, said compression means being open at the top and having a rigid body of material disposed therein, said connecting means including a connecting member having a portion thereof embedded within said body of material.

3. An assembly as defined in claim 2 wherein said connecting means includes a threaded member secured to the upper end of said second pier member, and nut means threaded on said threaded member for adjustably connecting said connecting member to said threaded member.

4. An assembly as defined in claim 2 wherein said body of material extends upwardly a substantial distance above said upper end of the compression means, said body of material having an upper surface, said upper end of the pier member extending above said upper surface.

5. The method of installing a pier assembly comprising, providing a pier member connected to a helix, said pier member having an upper end and a lower end and an intermediate portion therebetween with a compression means fixed in surrounding relation to said intermediate portion of the pier member, the compression means having an upper end and a lower end and an outer surface of generally frusto-conical configuration, rotating said pier member, said helix and said compression means thereby forcing said lower end of the pier member downwardly into earth therebeneath to move the compression means downwardly into the earth to uniformly compress and compact the earth therebeneath with the upper end of the pier member extending upwardly above said upper end of the compression means for supporting a structure on said upper end of the pier member.

6. The method as defined in claim 5 wherein said step of forcing said lower end of the pier member into the earth includes the steps of providing a helical pier member having a helix thereon, driving said helical pier member downwardly into the earth, providing an extension pier member, interconnecting said extension pier member with said helical pier member, and then driving said interconnected pier members further in a downward direction.

7. The method as defined in claim 5 including the step of forcing said lower end of the pier member into the earth until said upper end of the compression means is adjacent the surface of the earth therebeneath.

8. The method of installing a pier assembly comprising, providing a pier member having an upper end and a lower end and an intermediate portion therebetween with a compression means fixed in surrounding relation to said intermediate portion of the pier member, the compression means having an upper end and a lower end and tapering downwardly from a first dimension at the upper end thereof to a smaller dimension at the lower end thereof, forcing said lower end of the pier member downwardly into earth therebeneath to move the compression means downwardly into the earth to compress and compact the earth therebeneath with the upper end of the pier member extending upwardly above said upper end of the compression means for supporting a structure on said upper end of the pier member, said upper end of the compression means being open, and including the step of inserting material into said compression means through the open upper end thereof and forming a rigid body of material within the compression means.

9. The method of installing a pier assembly comprising, providing a pier member having an upper end and a lower end and an intermediate portion therebetween with a compression means fixed in surrounding relation to said intermediate portion of the pier member, the compression means having an upper end and a lower end and tapering downwardly from a first dimension at the upper end thereof to a smaller dimension at the lower end thereof, forcing said lower end of the pier member downwardly into earth therebeneath to move the compression means downwardly into the earth to compress and compact the earth therebeneath with the upper end of the pier member extending upwardly above said upper end of the compression means for supporting a structure on said upper end of the pier member, the upper end of said compression means being open, including the steps of providing a tubular member having an upper end and a lower end, placing the lower end of said tubular member in the open upper end of said compression means, and inserting material through the upper end of said tubular member to form a rigid body of material within the compression means and said tubular member.

10. The method of installing a pier assembly comprising, providing a pier member having an upper end and a lower end and an intermediate portion therebetween with a compression means fixed in surrounding relation to said intermediate portion of the pier member, the compression means having an upper end and a lower end and tapering downwardly from a first dimension at the upper end thereof to a smaller dimension at the lower end thereof, forcing said lower end of the pier member downwardly into earth therebeneath to move the compression means downwardly into the earth to compress and compact the earth therebeneath with the upper end of the pier member extending upwardly above said upper end of the compression means for supporting a structure on said upper end of the pier member, and including the steps of providing a batter pier having an upper end and a lower end, forcing said lower end of the batter pier downwardly into earth therebeneath at an angle to said first-mentioned pier member with said upper end of the batter pier extending above the surface of the earth, providing a connecting member, said compression means having an open upper end, placing said connecting member so that a portion thereof extends downwardly through said open upper end of the compression means into said compression means, connecting said upper end of the batter pier to said connecting member, and inserting material into said compression means through the open upper end thereof and forming a rigid body of material within the compression means with a portion of said connecting member embedded within said body of material.

11. The method as defined in claim 10 including the additional step of adjusting the connection between said upper end of the batter pier and said connecting member.

12. The method of installing a pier assembly comprising, providing a pier member having an upper end and a lower end and an intermediate portion therebetween with a compression means fixed in surrounding relation to said intermediate portion of the pier member, the compression means having an upper end and a lower end and tapering downwardly from a first dimension at the upper end thereof to a smaller dimension at the lower end thereof, forcing said lower end of the pier member downwardly into earth therebeneath to move the compression means downwardly into the earth to compress and compact the earth therebeneath with the upper end of the pier member extending upwardly above said upper end of the compression means for supporting a structure on said upper end of the pier member, and including the steps of providing a batter pier having an upper end and a lower end, forcing said lower end of the batter pier downwardly into earth therebeneath at an angle to said first-mentioned pier member with said upper end of the batter pier extending above the surface of the earth, said compression means having an open upper end, providing a tubular member having an upper end and a lower end, placing the lower end of said tubular member in the open upper end of said compression means, providing a connecting member, placing said connecting member so that a portion thereof extends downwardly through said upper end of the tubular member into said tubular member, connecting said upper end of the batter pier to said connecting member, and inserting material into said tubular member through the upper end thereof and forming a rigid body of material within the tubular member with a portion of said connecting member embedded within said body of material.

13. The method as defined in claim 12 including the additional step of adjusting the connection between said upper end of the batter pier and said connecting member.

* * * * *